US009462868B2

(12) United States Patent
Kim

(10) Patent No.: US 9,462,868 B2
(45) Date of Patent: Oct. 11, 2016

(54) HAIR DRYER SYSTEM

(71) Applicant: Yong Tok Kim, Riverview, FL (US)

(72) Inventor: Yong Tok Kim, Riverview, FL (US)

( * ) Notice: Subject to any disclaimer, the term of this patent is extended or adjusted under 35 U.S.C. 154(b) by 351 days.

(21) Appl. No.: 14/079,251

(22) Filed: Nov. 13, 2013

(65) Prior Publication Data

US 2014/0068959 A1 Mar. 13, 2014

Related U.S. Application Data

(63) Continuation-in-part of application No. 13/349,257, filed on Jan. 12, 2012, now abandoned.

(60) Provisional application No. 61/520,749, filed on Jun. 14, 2011, provisional application No. 61/627,376, filed on Oct. 11, 2011.

(51) Int. Cl.

| | |
|---|---|
| ***F26B 25/06*** | (2006.01) |
| ***A45D 20/12*** | (2006.01) |
| ***A45D 20/08*** | (2006.01) |
| ***A45D 20/14*** | (2006.01) |

(52) U.S. Cl.

CPC ..... *A45D 20/08* (2013.01); *A45D 20/14* (2013.01)

(58) Field of Classification Search

CPC ..... A45D 20/08; A45D 20/14

USPC ..... 34/96–101, 283, 201, 202, 211, 215, 34/222, 237; 119/431, 432; 220/553, 4.28, 220/6, 520; 312/283, 290, 213

See application file for complete search history.

(56) References Cited

U.S. PATENT DOCUMENTS

| | | | | |
|---|---|---|---|---|
| 1,451,468 A * | 4/1923 | Olshan | B65D 7/26 220/6 |
| 4,158,262 A * | 6/1979 | Grasso | F26B 25/06 34/104 |
| 2005/0102850 A1* | 5/2005 | Hill | F26B 9/063 34/58 |

* cited by examiner

*Primary Examiner* — Kenneth Rinehart
*Assistant Examiner* — John McCormack

(57) ABSTRACT

A housing has upper and lower walls. The upper wall has fixed and movable sections. The housing has a fixed end wall and a movable end wall. The housing has side walls. The side walls couple the fixed end wall, the fixed section of the upper wall, and a portion of the lower wall. A first hinge couples the movable end wall with the lower wall remote from the fixed end wall. A second hinge couples the movable end wall and the movable section of the upper wall. A baffle is provided parallel with and spaced from the fixed end wall. The baffle forms first and second zones. The first end zone is provided between the baffle and fixed end wall. The second end zone is provided between the baffle and the side of the baffle remote from the fixed end wall.

7 Claims, 7 Drawing Sheets

10

40
44
46
14
26
20
38
18
24
34
49
22
52
42
28
50
47
INDICIA
16
94
56
78
92
4
4
90
96
84
86

HAIR DRYER SYSTEM

RELATED APPLICATION

The present application is a continuation-in-part of pending application Ser. No. 13/349,257 filed Jan. 12, 2012 which is base upon Provisional Applications No. 61/520,749 filed Jun. 14, 2011 and 61/627,376 filed Oct. 11, 2011, the subject matter of which applications is incorporated herein by reference.

BACKGROUND OF THE INVENTION

Field of the Invention

The present invention relates to a hair dryer system and more particularly pertains to blow drying long hair of a user and, optionally, for blow drying hair of a wig, the blow drying being done in a rapid, safe, comfortable, convenient and economical manner.

SUMMARY OF THE INVENTION

In view of the foregoing disadvantages inherent in the known types of hair styling systems of known designs and configurations now present in the prior art, the present invention provides an improved hair dryer system. As such, the general purpose of the present invention, which will be described subsequently in greater detail, is to provide a new and improved hair dryer system and method which has all the advantages of the prior art and none of the disadvantages.

To attain this, the present invention essentially comprises a housing. The housing has upper and lower walls. The upper wall has fixed and movable sections. The housing has a fixed end wall. The housing also has a movable end wall. The housing has side walls. The side walls couple the fixed end wall, the fixed section of the upper wall, and a portion of the lower wall. A first hinge is provided. The first hinge couples the movable end wall with the lower wall remote from the fixed end wall. A second hinge is provided. The second hinge couples the movable end wall and the movable section of the upper wall. A baffle is provided. The baffle is provided parallel with and spaced from the fixed end wall. The baffle forms first and second zones. The first end zone is positioned between the baffle and the fixed end wall. The second end zone is positioned between the baffle and the side of the baffle remote from the fixed end wall.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hair dryer system which has all of the advantages of the prior art hair styling systems of known designs and configurations and none of the disadvantages.

It is another object of the present invention to provide a new and improved hair dryer system which may be easily and efficiently manufactured and marketed.

It is further object of the present invention to provide a new and improved hair dryer system which is of durable and reliable constructions.

An even further object of the present invention is to provide a new and improved hair dryer system which is susceptible of a low cost of manufacture with regard to both materials and labor, and which accordingly is then susceptible of low prices of sale to the consuming public, thereby making such hair dryer system economically available to the buying public.

Lastly, another object of the present invention is to provide a hair dryer system for blow drying long hair of a user and, optionally, for blow drying hair of a wig, the blow drying being done in a rapid, safe, comfortable, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
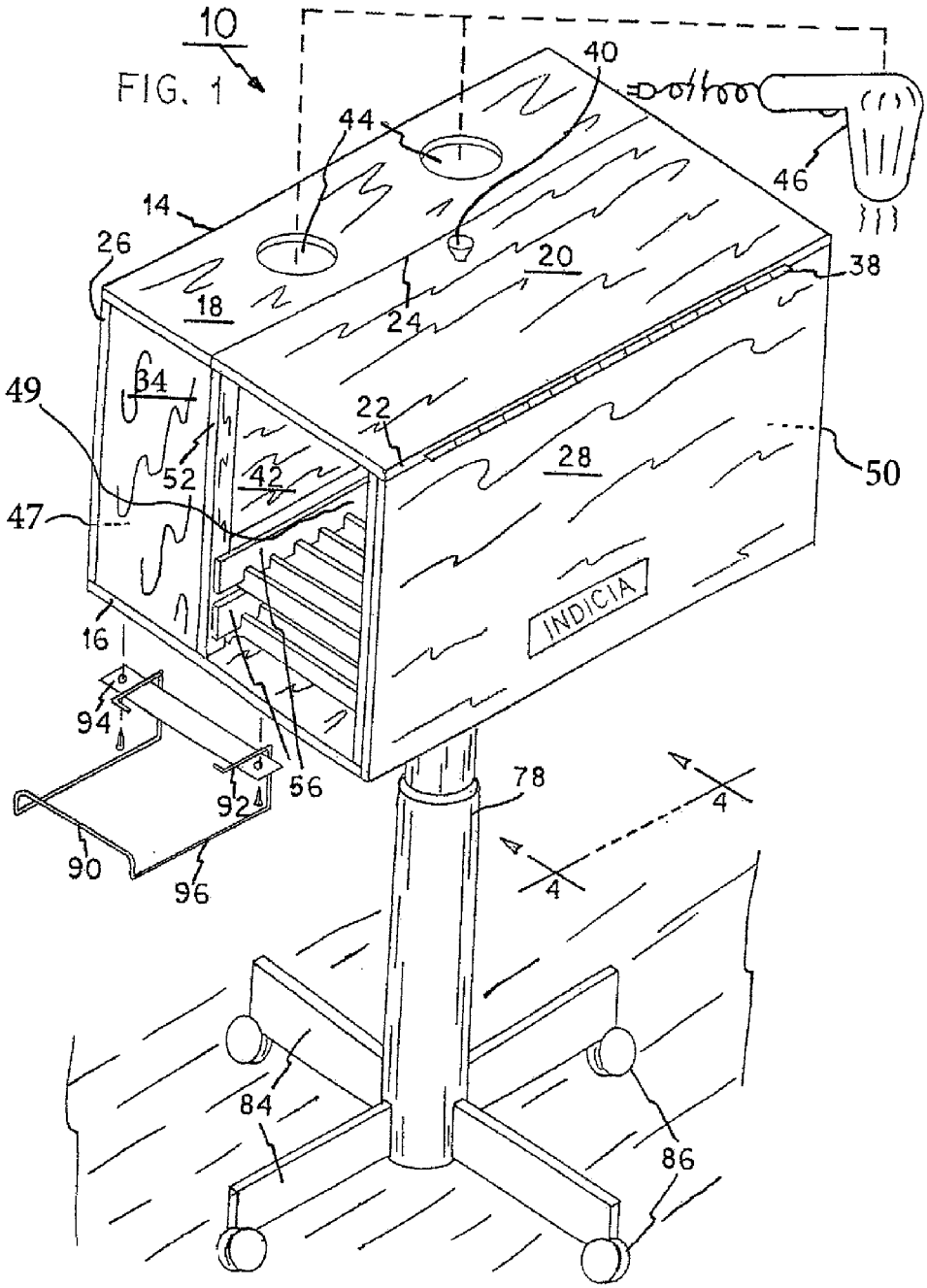
FIGS. 1 and 2 are exploded perspective illustrations of a hair dryer system constructed in accordance with the principles of the present invention.
Figure 2:
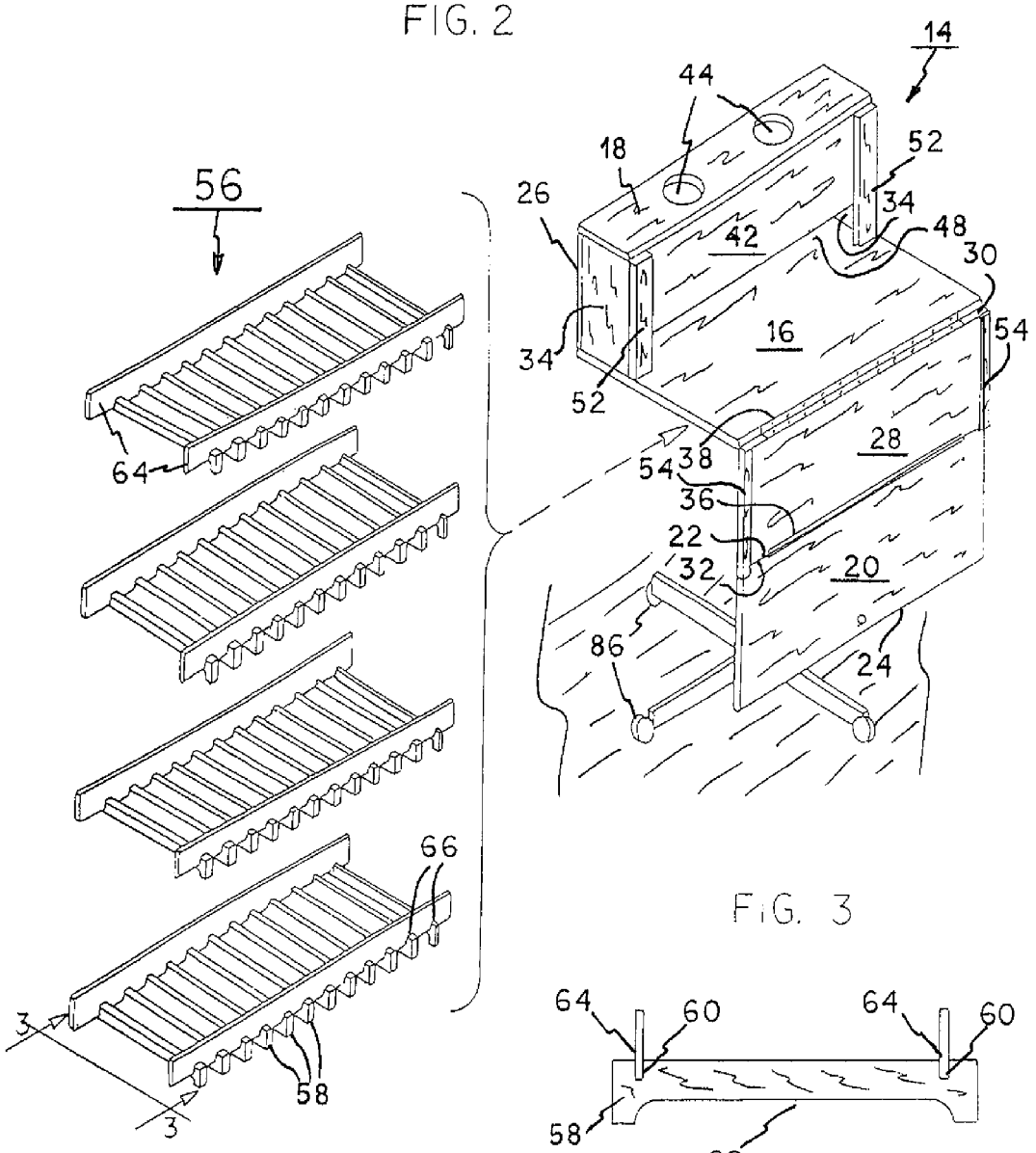
Figure 3:
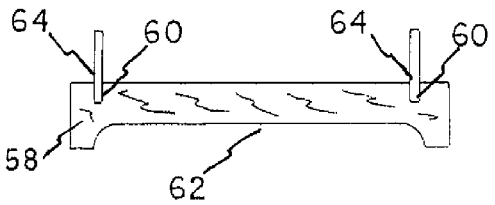
FIG. 3 is an enlarged end view of one rack taken along line 3-3 of FIG. 2.
Figure 5:
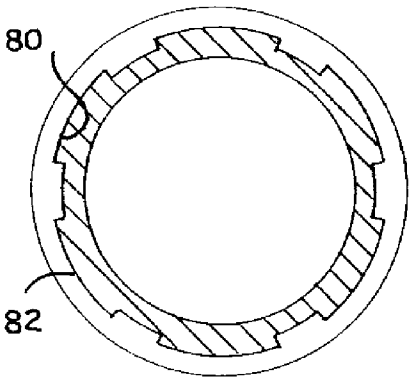
FIGS. 5 and 6 are cross sectional views taken along line 7-7 of FIG. 4, the views illustrating alternate embodiments of the invention.
Figure 6:
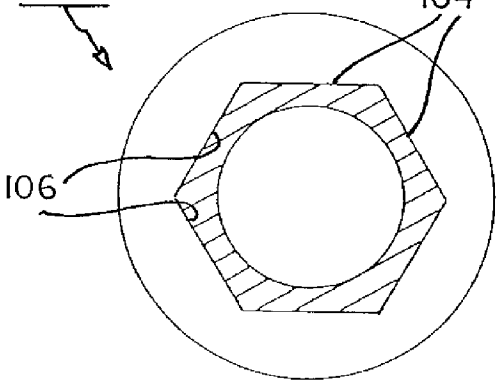
Figure 4:
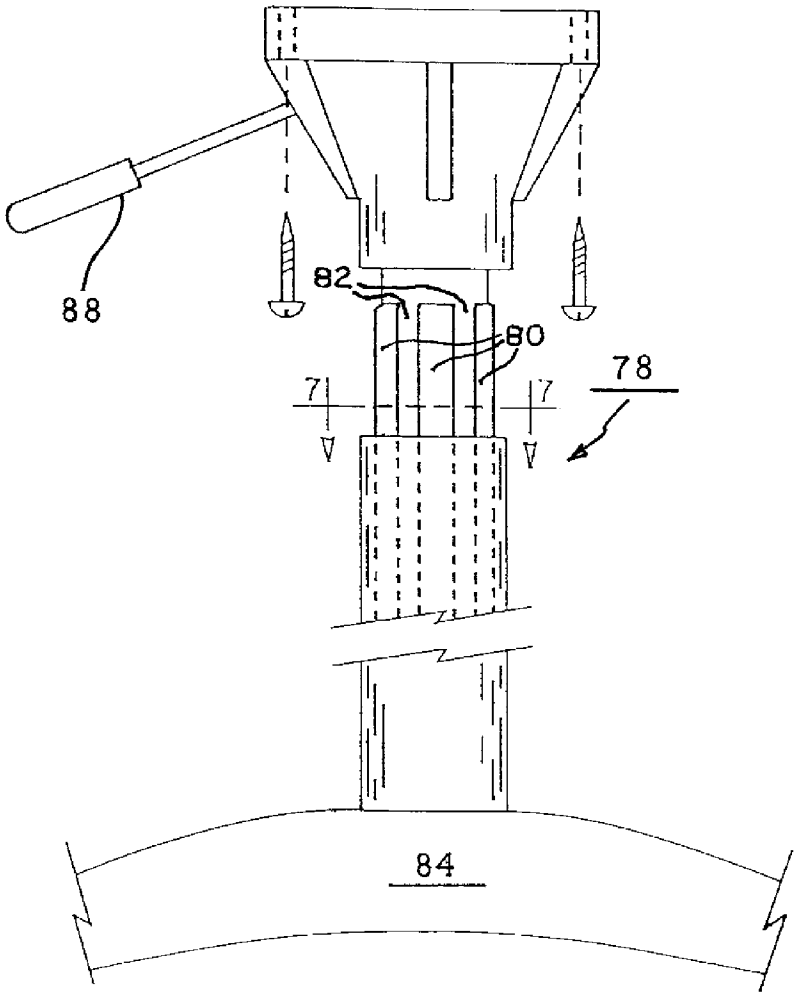
FIG. 4 is an enlarged exploded side elevational view taken along line 4-4 of FIG. 1.
Figure 7:
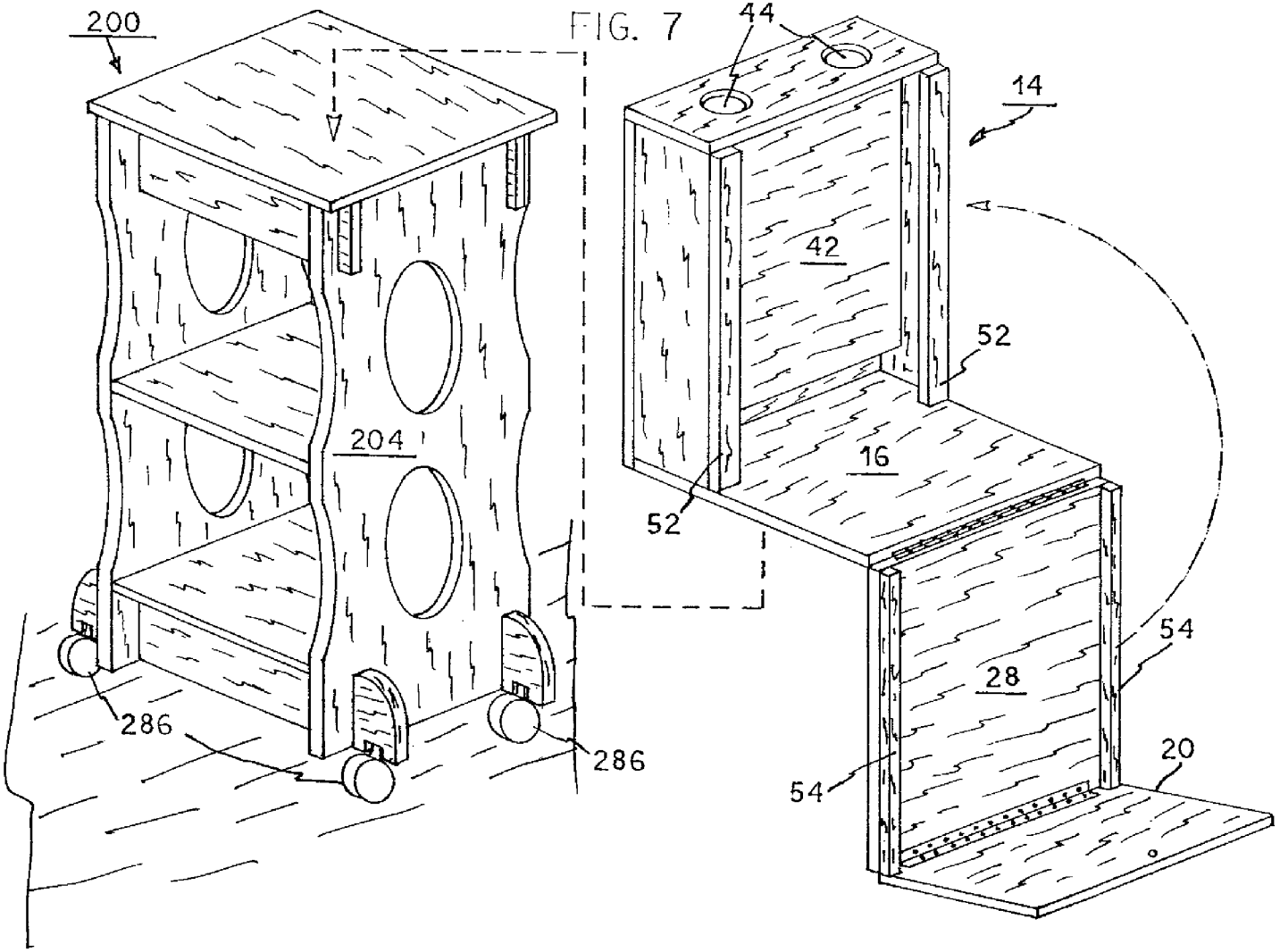
FIG. 7 is an exploded perspective view similar to FIG. 2 but illustrating a fixed base rather than the height adjustable base of the prior Figures.
Figure 8:
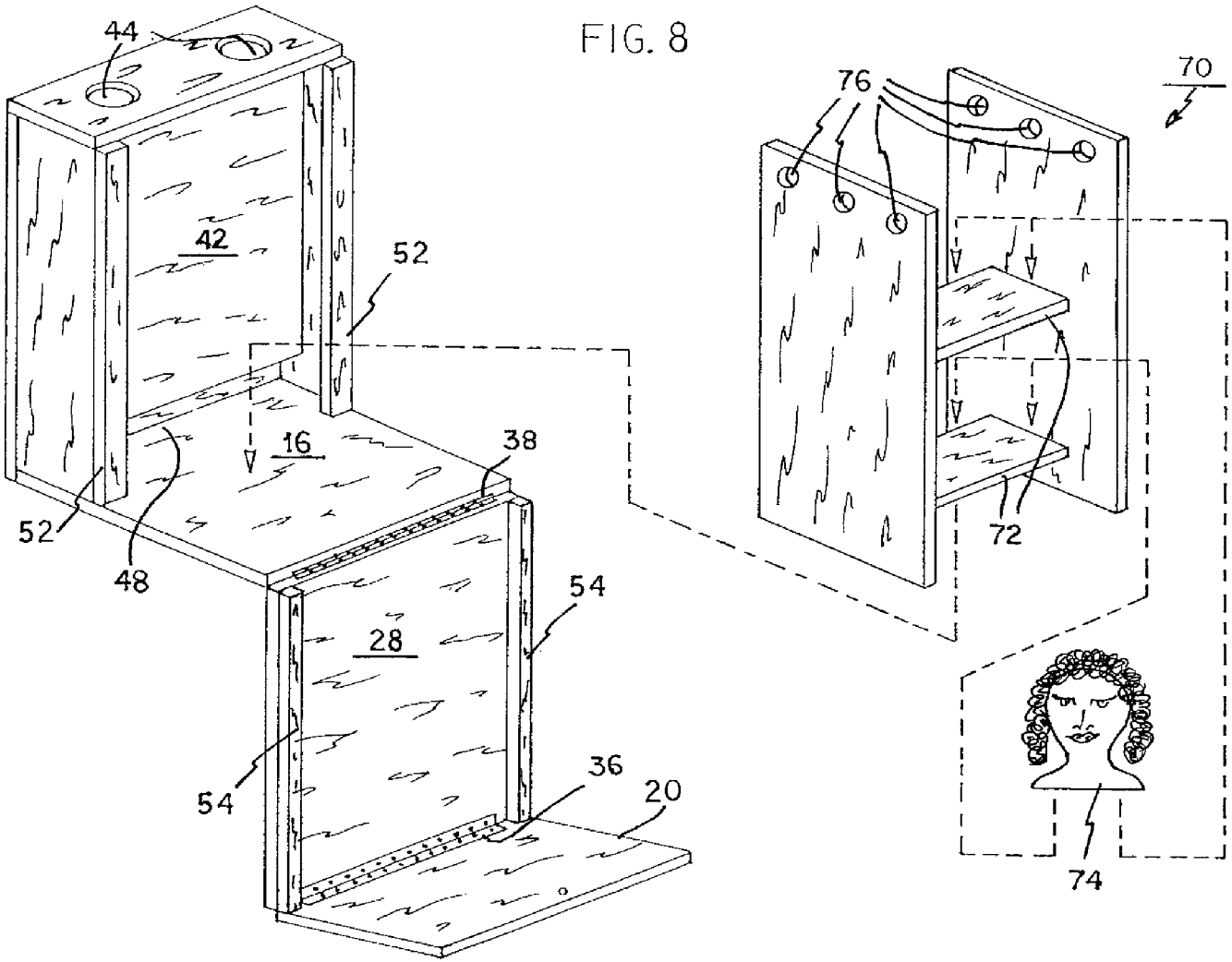
FIG. 8 is an exploded perspective view similar to FIGS. 2 and 7 but illustrating an insert for wigs rather than the insert with racks of the prior Figures.

With reference now to the drawings, and in particular to FIG. 1 thereof, the preferred embodiment of the new and improved hair dryer system embodying the principles and concepts of the present invention and generally designated by the reference numeral 10 will be described.

The present invention, the hair dryer system 10 is comprised of a plurality of components. Such components in their broadest context include a housing and a baffle. Such components are individually configured and correlated with respect to each other so as to attain the desired objective.

First provided is a housing 14. The housing in a generally rectilinear configuration. The housing has a horizontal lower wall 16. The housing has an upper wall. The housing has a horizontal fixed section 18. The housing has a movable section 20. The movable section has an interior edge 22. The movable section also has an exterior edge 24. The housing has a vertical fixed end wall 26. The housing has a movable end wall 28. The movable end wall has an inner edge 30. The movable end wall has an outer edge 32. The housing has laterally spaced vertical side walls 34. The side walls couple the fixed end wall, the fixed section of the upper wall, and a portion of the lower wall. A first hinge 36. The first hinge couples the inner edge of the movable end wall with the lower wall remote from the fixed end wall. A second hinge 38 is provided. The second hinge couples the outer edge of the movable end wall and the interior edge of the movable section of the upper wall. The housing is adapted to convert between an open orientation and a closed orientation. In the open orientation both the movable end wall and the movable section of the upper wall hang vertically downwardly from the lower wall. In the closed orientation the movable end wall extends upwardly vertically and the movable section of the upper wall extend horizontally. Further in the closed orientation the fixed and movable sections of the upper wall are in coplanar contact with each other. A knob 40 is provided. The knob is provided on the movable section of the upper wall. In this manner movement between the open and closed orientations is facilitated.

An air flow path is provided through the housing. The air flow path has a vertical baffle 42. The vertical baffle is provided within the housing. The baffle is provided parallel with and spaced from the fixed end wall. The baffle has a top. The top is provided in contact with the fixed section of the upper wall. The baffle has a bottom. The bottom is elevationally spaced from the bottom wall. The baffle has sides. The sides of the baffle are provided in contact with the side walls of the housing. The fixed end wall and the baffle each have a height. The height of the baffle us between 50 and 90 percent of the height of the fixed end wall. The air flow path has a first zone. The first zone is provided between the baffle and the fixed end wall. The air flow path has a second zone. The second zone is provided on the side of the baffle remote from the fixed end wall. The fixed section of the upper wall has two holes 44. In this manner an air input end of the first zone is defined. The two holes are adapted to support electric hair dryers 46. Only one hair drier is shown. A passageway 48. The passageway is provided beneath the baffle. In this manner an air output end of the first zone is defined. Further in the manner an air input end of the second zone is defined. When in the closed orientation, the housing has lateral openings 50. The lateral openings are spaced from and parallel with the side walls. In this manner air output ends of the second zone are defined. The air flow path extends downwardly through the first zone then upwardly and outwardly through the second zone. Fixed thin positioning strips 52 are provided. The fixed thin positioning strips are provided in the second zone adjacent to the baffle. The fixed thin positioning strips cover the end sections of the passageway. Movable thin positioning strips 54. The movable thin positioning strips are provided in the second zone on the movable end wall.

Provided next is a plurality of ladder-shaped hair supports 56. The ladder-shaped hair supports are positionable within the second zone. Each one of the plurality of the ladder-shaped supports includes a plurality of short slats 58. Each one of the plurality of short slats has two upwardly facing end short recesses 60. Each one of the plurality of short slats has one enlarged central downwardly facing recess 62. Each one of the ladder shaped supports has two long slats 64. Each one of the ladder shaped supports has a downwardly facing co-operable recess 66. The recess receives the end short recesses of the short slats. The short slats have ends. The ends are positionable between the positioning strips. In this manner the proper positioning of the hair supports within the second zone is facilitated. The hair supports is stackable one above the other. Layers of long hair of the user rest upon the hair supports of the stack.

A rack 70 is provided next. A plurality of shelves 72 is provided. A plurality of mannequin heads 74 is provided. The mannequin heads have wigs. The mannequin heads and wings are positionable on the shelves. The upper extents of the rack have vent holes 76. In this manner drying air exiting from the second zone is facilitated. Only one mannequin head with wig is shown. The rack and mannequin heads with wigs are positionable within the second zone. In this manner drying hair on the wigs is an alternative to the hair supports.

Further provided is a support post 78. The support post has an upper end. The upper end is coupled by threaded fasteners to a central extent of the lower wall. The upper end has an axial recess 80. The lower end has an axial projection 82. The axial projection is slidably received in the axial recess. In this manner unintended rotation of the housing is abated. The lower end has legs 84. The lower end has a plurality of wheels 86. In this manner the re-positioning of the housing if facilitated. The support post has a handle 88. In this manner raising and lowering the housing if facilitated.

Provided last is a wire retainer 90. The wire retainer has horizontal short fingers 92. The wire retainer has a support piece 94. In this manner the wire retainer is coupled to and depends from the lower wall of the housing. The wire retainer has horizontal long fingers 96. The fingers are adapted to removably receive and support a plurality of racks.

In alternate embodiment of the present invention, the system 100 has a height adjustable support post. The height adjustable support has an upper section and a lower section. The upper section has an upper end. The upper end is coupled to a central extent of the lower wall. The upper section has a cross section. The cross section has an exterior surface 104. The exterior surface is in the form of a polygon. The lower section has a cross section. The cross section has an interior surface 106. The interior surface is in the form of a polygon. The shape of the polygon corresponds to the polygon of the upper section. The lower section are slidably received in the upper section. The cross sectional configurations are adapted to abate unintended rotation of the housing.

In another alternate embodiment of the present invention, the system 200 includes a support assembly 204. The support assembly has an upper end. The upper end is coupled to a central extent of the lower wall. The support assembly has a lower end. The support assembly has wheels 286. The wheels are received upon a recipient surface. The support assembly retains the housing at a fixed height with respect to the recipient surface. In this manner repositioning of the system is facilitated.

Figure 9:
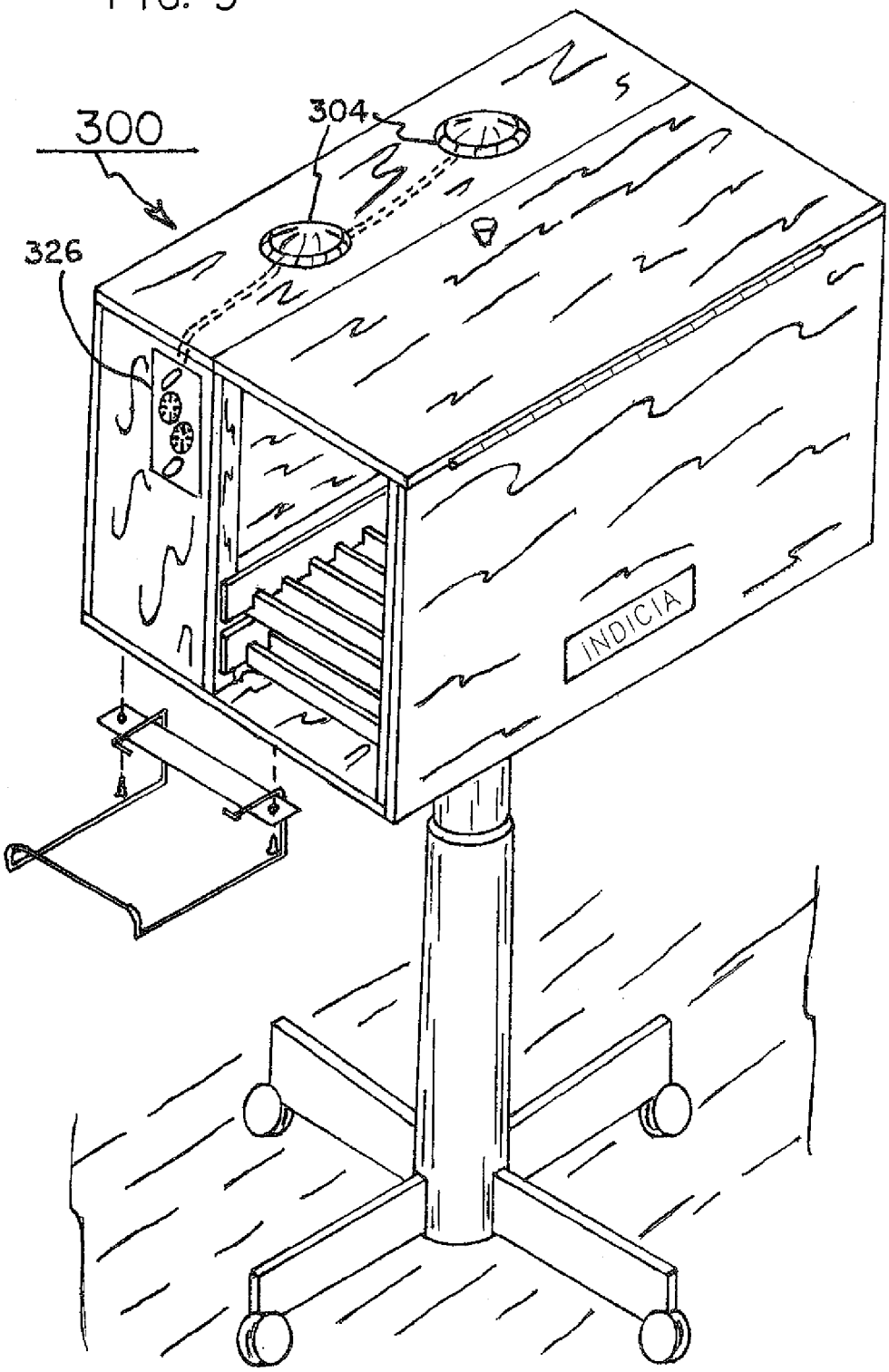
FIG. 9 is a perspective showing similar to FIG. 1 but illustrating an alternate embodiment of the invention.
Figure 11:
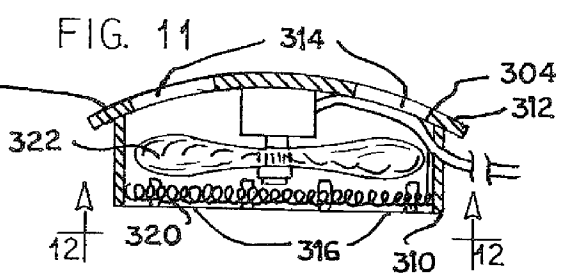
FIG. 11 is a cross sectional view taken along line 11-11 of FIG. 10.
Figure 10:
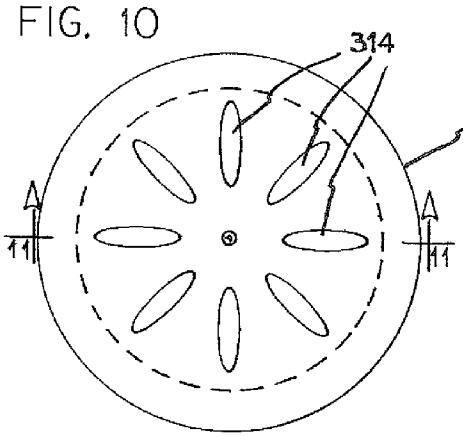
FIG. 10 is a plan view of one of the ports of the FIG. 10 embodiment.
Figure 12:
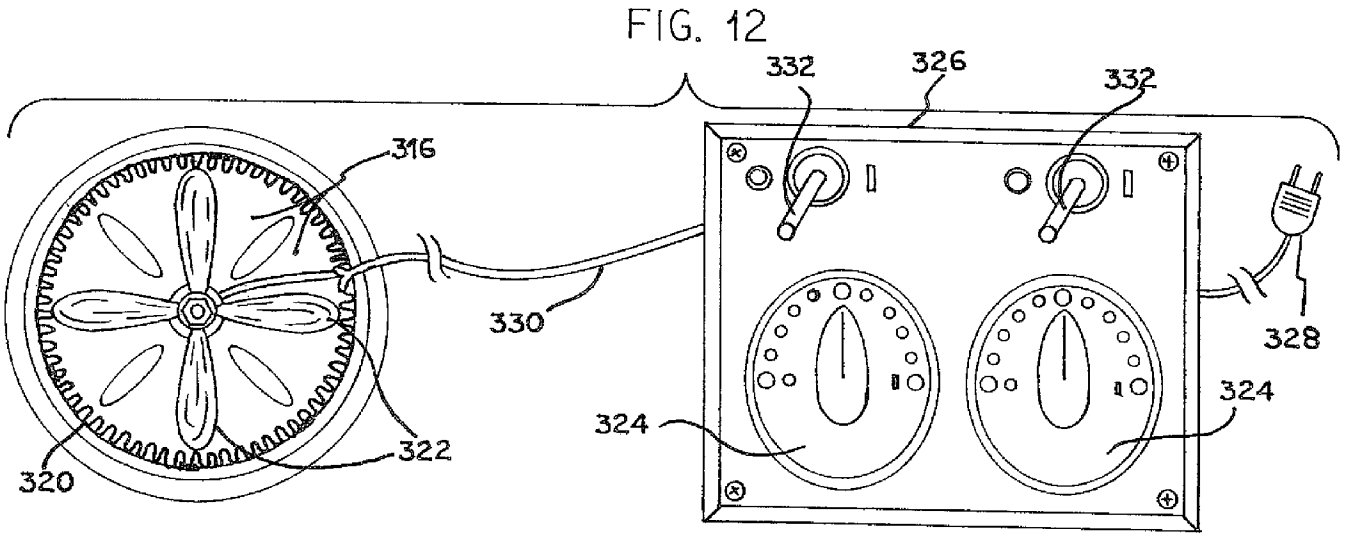
FIG. 12 is a bottom view of the electrical controls taken partially along line 12-12 of FIG. 11.

FIG. 9 is a perspective showing similar to FIG. 1 but illustrating an alternate embodiment 300 of the invention. In such embodiment, the two holes 44 for receipt of the removable hair dryers are replaced by permanently positioned heaters 304. Note FIG. 9. The heaters are similarly constructed. Only one heater is shown in FIGS. 10-12 and described herein.

Each heater 304 includes a housing 308 with a cylindrical lower section 310 and a curved upper section 312 forming a chamber within the housing. The upper section is formed with oval-shaped radial input slots 314 for the receipt of ambient input air. The lower section is formed with oval-shaped radial output slots 316 for the dispensing of heated output air.

Within the housing is a heater in the form of coils 320 for heating air passing through the chamber. Also within the housing is a fan with rotating blades 322 for moving the air through the chamber as it is being heated.

Lastly provided is a control assembly 326. The control assembly includes a first line 328 to a source of electrical potential. The control assembly also includes a second line 330 from the heater and the fan to an operator controlled switch 332 and an operator controlled dial 334 for controlling the heater and the fan. Note FIG. 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair dryer system comprising:

a housing having upper and lower walls, the upper wall formed of fixed and movable sections, the housing having a fixed end wall and a movable end wall, the housing having side walls coupling the fixed end wall and the fixed section of the upper wall and a portion of the lower wall, a first hinge coupling the movable end wall with the lower wall remote from the fixed end wall, a second hinge coupling the movable end wall and the movable section of the upper wall; and a baffle parallel with and spaced from the fixed end wall, the baffle forming first and second zones, the first zone between the baffle and fixed end wall and the second zone between the baffle and the side of the baffle remote from the fixed end wall;

a plurality of racks optionally removably positioned in the second zone for receiving hair in layers to be dried; and a wire retainer having horizontal first fingers and a support piece for securing the wire retainer to and depending from the lower wall of the housing, the wire retainer having horizontal second fingers adapted to removably receive a plurality of racks.

2. The system as set forth in claim 1 and further including:

a mannequin head optionally removably positioned in the second zone for receiving a wig with hair to be dried.

3. A hair dryer system comprising:

a housing having upper and lower walls, the upper wall formed of fixed and movable sections, the housing having a fixed end wall and a movable end wall, the housing having side walls coupling the fixed end wall and the fixed section of the upper wall and a portion of the lower wall, a first hinge coupling the movable end wall with the lower wall remote from the fixed end wall, a second hinge coupling the movable end wall and the movable section of the upper wall;

a baffle parallel with and spaced from the fixed end wall, the baffle forming first and second zones, the first zone between the baffle and fixed end wall and the second zone between the baffle and the side of the baffle remote from the fixed end wall; and a height adjustable support post having an upper section and a lower section, the upper section having an upper end coupled to a central extent of the lower wall, the upper section having an axial recess, the lower section having an axial projection slidably received in the axial recess to abate unintended rotation of the housing, the lower section having a lower end with wheels for repositioning the system on a recipient surface.

4. A hair dryer system comprising:

a housing having upper and lower walls, the upper wall formed of fixed and movable sections, the housing having a fixed end wall and a movable end wall, the housing having side walls coupling the fixed end wall and the fixed section of the upper wall and a portion of the lower wall, a first hinge coupling the movable end wall with the lower wall remote from the fixed end wall, a second hinge coupling the movable end wall and the movable section of the upper wall;

a baffle parallel with and spaced from the fixed end wall, the baffle forming first and second zones, the first zone between the baffle and fixed end wall and the second zone between the baffle and the side of the baffle remote from the fixed end wall; and a height adjustable support post having an upper section and a lower section, the upper section having an upper end coupled to a central extent of the lower wall, the upper section having a cross section with an exterior surface (104) in the form of a polygon, the lower section having a cross section with an interior surface (106) in the form of a polygon corresponding to the polygon of the upper section, the lower section being slidably received in the upper section with the cross sectional configurations adapted to abate unintended rotation of the housing.

5. A hair dryer system comprising:

a housing having upper and lower walls, the upper wall formed of fixed and movable sections, the housing having a fixed end wall and a movable end wall, the housing having side walls coupling the fixed end wall and the fixed section of the upper wall and a portion of the lower wall, a first hinge coupling the movable end wall with the lower wall remote from the fixed end wall, a second hinge coupling the movable end wall and the movable section of the upper wall;

a baffle parallel with and spaced from the fixed end wall, the baffle forming first and second zones, the first zone between the baffle and fixed end wall and the second zone between the baffle and the side of the baffle remote from the fixed end wall; and a support assembly (204) having an upper end coupled to a central extent of the lower wall, the support assembly having a lower end with wheels received upon a recipient surface, the support assembly retaining the housing at a fixed height with respect to the recipient surface, the support assembly including wheels (286) to facilitate repositioning of the system.

6. A hair dryer system comprising:

a housing having upper and lower walls, the upper wall formed of fixed and movable sections, the housing having a fixed end wall and a movable end wall, the housing having side walls coupling the fixed end wall and the fixed section of the upper wall and a portion of the lower wall, a first hinge coupling the movable end wall with the lower wall remote from the fixed end wall, a second hinge coupling the movable end wall and the movable section of the upper wall; and a baffle parallel with and spaced from the fixed end wall, the baffle forming first and second zones, the first zone between the baffle and fixed end wall and the second zone between the baffle and the side of the baffle remote from the fixed end wall;

at least one hole in the fixed section of the upper wall defining an air input end;

laterally spaced openings on the second zone defining air outlet ends;

a heater (304) in the at least one hole, the heater having a housing (308) with a lower section (310) and an upper section (312) forming a chamber within the housing, the upper section being formed with input slots (314) for the receipt of ambient input air and output slots (316) for the dispensing of heated output air;

a heater in the chamber formed of coils (320) for heating air passing through the chamber;

a fan in the chamber with rotating blades (322) for moving the air through the chamber as it is being heated; and a control assembly (326) including a first line (328) to a source of electrical potential, the control assembly also includes a second line (330) from the heater and the fan to an operator controlled switch (332) and an operator controlled dial (334) for controlling the heater and the fan.

7. A hair dryer system (10) for blow drying hair of a user and, optionally, for blow drying hair of a wig, comprising, in combination:

a housing (14) in a generally rectilinear configuration, the housing having a horizontal lower wall (16) and an upper wall formed of a horizontal fixed section (18) and a movable section (20), the movable section having an interior edge (22) and an exterior edge (24), the housing having a vertical fixed end wall (26) and a movable end wall (28), the movable end wall having an inner edge (30) and an outer edge (32), the housing having laterally spaced vertical side walls (34) coupling the fixed end wall and the fixed section of the upper wall and a portion of the lower wall, a first hinge (36) coupling the inner edge of the movable end wall with the lower wall remote from the fixed end wall, a second hinge (38) coupling the outer edge of the movable end wall and the interior edge of the movable section of the upper wall, the housing adapted to convert between an open orientation and a closed orientation, the open orientation being with both the movable end wall and the movable section of the upper wall hanging vertically downwardly from the lower wall, the closed orientation being with the movable end wall extending upwardly vertically and with the movable section of the upper wall extending horizontally with the fixed and movable sections of the upper wall in coplanar contact with each other, a knob (40) on the movable section of the upper wall to facilitate movement between the open and closed orientations;

an air flow path through the housing, the air flow path including a vertical baffle (42) within the housing parallel with and spaced from the fixed end wall, the baffle having a top in contact with the fixed section of the upper wall, the baffle having a bottom elevationally spaced from the bottom wall, the baffle having sides in contact with the side walls of the housing, the fixed end wall and the baffle each having a height with the height of the baffle being between 50 and 90 percent of the height of the fixed end wall, the air flow path having a first (zone 47) between the baffle and the fixed end wall, the air flow path having a second zone (49) on the side of the baffle remote from the fixed end wall, two holes (44) in the fixed section of the upper wall defining an air input end of the first zone, the two holes adapted to support electric hair dryers (46), a passageway (48) beneath the baffle defining an air output end of the first zone and defining an air input end of the second zone, lateral openings (50) in the housing when in the closed orientation, the lateral openings being spaced from and parallel with the side walls and defining air output ends of the second zone, the air flow path extending downwardly through the first zone then upwardly and outwardly through the second zone, fixed thin positioning strips (52) in the second zone adjacent to the baffle and covering end sections of the passageway, movable thin positioning strips (54) in the second zone on the movable end wall;

a plurality of ladder-shaped hair supports (56) positionable within the second zone, each one of the plurality of the ladder-shaped supports including a plurality of first slats (58), each one of the plurality of first slats formed with two upwardly facing end short recesses (60) and one enlarged central downwardly facing recess (62), each one of the ladder shaped supports including two second slats (64) with downwardly facing co-operable recess (66) receiving the end short recesses of the first slats, the first slats having ends positionable between the positioning strips to facilitate proper positioning of the hair supports within the second zone, the hair supports being stackable one above the other with layers of hair of the user resting upon the hair supports of the stack;

a rack (70) with a plurality of shelves (72), a plurality of mannequin heads (74) with wigs positionable on the shelves, vent holes (76) in upper extents of the rack to facilitate drying air in exiting from the second zone; the rack and mannequin heads with wigs positionable within the second zone for drying hair on the wigs as an alternative to the hair supports;

a support post (78) having an upper end coupled by threaded fasteners to a central extent of the lower wall, the upper end having an axial recess (80), the lower end having an axial projection (82) slidably received in the axial recess to abate unintended rotation of the housing, the lower end having legs (84) with a plurality of wheels (86) for facilitating the re-positioning of the housing, the support post including a handle (88) to facilitate raising and lowering the housing; and a wire retainer (90) having horizontal first fingers (92) and a support piece (94) for securing the wire retainer to and depending from the lower wall of the housing, the wire retainer having horizontal second fingers (96) adapted to removably receive and support a plurality of racks.

* * * * *